US006003583A

United States Patent [19]

Lacoste et al.

[11] Patent Number: 6,003,583

[45] Date of Patent: Dec. 21, 1999

[54] DOOR OPENING SCREENING SYSTEM

[76] Inventors: Kevin Lacoste; Karen Lacoste, both of 8416 Fairfax Dr., Chalmette, La. 70043

[21] Appl. No.: 09/130,613

[22] Filed: Aug. 6, 1998

[51] Int. Cl.[6] ..... A47H 1/00

[52] U.S. Cl. ..... 160/122; 160/264; 160/273.1; 160/DIG. 16; 292/DIG. 46

[58] Field of Search ..... 160/98, 104, 107, 160/113, 117, 118, 119, 120, 122, 133, 201, 264, 268.1, 272, 273.1, 290.1, DIG. 10, DIG. 16; 292/DIG. 30, DIG. 41, DIG. 46

[56] References Cited

U.S. PATENT DOCUMENTS

| | | | |
|---|---|---|---|
| 402,493 | 4/1889 | Thomas | 292/DIG. 46 X |
| 972,422 | 10/1910 | Whitmore | 160/264 |
| 1,143,863 | 6/1915 | Schenk | 160/264 |
| 1,151,260 | 8/1915 | Flannery | 292/DIG. 46 X |
| 1,344,758 | 6/1920 | Donnelly | 160/DIG. 10 X |
| 1,356,083 | 10/1920 | Nelson | 160/273.1 X |
| 1,458,617 | 6/1923 | De Smidt | 160/273.1 X |
| 1,583,133 | 5/1926 | Fierman | 160/268.1 X |
| 1,715,858 | 6/1929 | Nelson | 160/273.1 X |
| 1,716,285 | 6/1929 | Szako | 160/273.1 X |
| 1,849,371 | 3/1932 | Gronbech | 160/122 |
| 2,604,159 | 7/1952 | Wright | 160/DIG. 16 X |
| 3,004,592 | 10/1961 | Norton | 160/114 |
| 3,455,366 | 7/1969 | Bogumil | 160/368 |
| 3,763,917 | 10/1973 | Antinone | 160/354 |
| 3,827,019 | 7/1974 | Serbu | 160/DIG. 16 X |
| 5,099,905 | 3/1992 | Rigter | 160/264 X |
| 5,323,835 | 6/1994 | Bachmeier | 160/89 |
| 5,358,025 | 10/1994 | Wood | 160/368.1 |
| 5,427,169 | 6/1995 | Saulters | 160/368.1 |
| 5,479,979 | 1/1996 | Hayashiguchi | 160/273.1 X |
| 5,505,244 | 4/1996 | Thumann | 160/290.1 X |

*Primary Examiner*—David M. Purol
*Assistant Examiner*—Bruce A. Lev
*Attorney, Agent, or Firm*—Joseph N. Breaux

[57] ABSTRACT

A door opening screening system that is suitable for screening large garage door openings and that includes two retractable screen assemblies that are deployed across the garage door opening and that are secured together to form a screen across the garage door opening. The door opening screening system also includes at least one screen assembly trackway section that is attachable above a doorway opening and that includes a resilient U-shaped trackway guide member that forms a screen guide channel sized to receive and hold a top edge of a screen assembly.

1 Claim, 2 Drawing Sheets

DOOR OPENING SCREENING SYSTEM

TECHNICAL FIELD

The present invention relates to screening structures for openings into buildings and more particularly to a door opening screening system that is suitable for screening large garage door openings, the door opening screening system including at least one screen assembly trackway section attachable above a doorway opening and two screen storage columns attachable on either side of a doorway opening; each screen storage column having an L-shaped mounting flange extending therefrom and a housing defining a screen assembly storage chamber that is accessible through an elongated rectangular screen assembly access opening formed longitudinally along a housing side wall, a screen retraction assembly including a screen spool mounted within the screen assembly storage chamber, a screen assembly including a length of plastic screening having rigid aluminum vertical supports spaced along the length thereof and having a first screen end attached to the screen spool; a last vertical support of each screen assembly having magnets provided along the side length thereof and a locking handle with a locking mechanism; the locking handle being sized to prevent passage of the last vertical support through the screen assembly access opening; the at least one screen assembly trackway section including a rigid metal guide support having a mounting flange portion in connection with a guide channel attachment section and a resilient U-shaped trackway guide member forming a screen guide channel sized to receive and hold a top edge of a screen assembly; the resilient U-shaped trackway guide member being attached to the guide channel attachment section such that the screen guide channel opening is oriented at a right angle with respect to the mounting flange; the last vertical supports of the two screen assemblies being positionable adjacent to and in parallel with each other such that the sealing magnets of one last vertical support are in registration with the sealing magnets of the other last vertical support and the locking handle of one last vertical support is lockable to the locking handle of the other last vertical support; each screen storage column being a mirror image of the other screen storage column.

BACKGROUND ART

It is often desirable to use the large space provided in a garage for hobbies such as wood working or other activities such as exercising. Although garages can provide ample space for such activities, garages often have little ventilation available without opening the large garage door. Opening the garage door can provide ventilation, however, insects, animals and other annoyances can enter the garage space when the garage door is open. It would be a benefit, therefore, to have a screening system for screening the garage door opening when the garage door is opened so that airflow could be provided to the garage space while insects, animals and other annoyances are kept out.

GENERAL SUMMARY DISCUSSION OF INVENTION

It is thus an object of the invention to provide a door opening screening system that is suitable for screening large garage door openings.

It is a further object of the invention to provide a door opening screening system that includes two retractable screen assemblies that are deployed across the garage door opening and that are secured together to form a screen across the garage door opening.

It is a still further object of the invention to provide a door opening screening system that includes at least one screen assembly trackway section attachable above a doorway opening and two screen storage columns attachable on either side of a doorway opening; each screen storage column having an L-shaped mounting flange extending therefrom and a housing defining a screen assembly storage chamber that is accessible through an elongated rectangular screen assembly access opening formed longitudinally along a housing side wall, a screen retraction assembly including a screen spool mounted within the screen assembly storage chamber, a screen assembly including a length of plastic screening having rigid aluminum vertical supports spaced along the length thereof and having a first screen end attached to the screen spool; a last vertical support of each screen assembly having magnets provided along the side length thereof and a locking handle with a locking mechanism; the locking handle being sized to prevent passage of the last vertical support through the screen assembly access opening; the at least one screen assembly trackway section including a rigid metal guide support having a mounting flange portion in connection with a guide channel attachment section and a resilient U-shaped trackway guide member forming a screen guide channel sized to receive and hold a top edge of a screen assembly; the resilient U-shaped trackway guide member being attached to the guide channel attachment section such that the screen guide channel opening is oriented at a right angle with respect to the mounting flange; the last vertical supports of the two screen assemblies being positionable adjacent to and in parallel with each other such that the sealing magnets of one last vertical support are in registration with the sealing magnets of the other last vertical support and the locking handle of one last vertical support is lockable to the locking handle of the other last vertical support; each screen storage column being a mirror image of the other screen storage column.

It is a still further object of the invention to provide a door opening screening system that accomplishes one or more of the above objects in combination.

Accordingly, a door opening screening system is provided. The door opening screening system includes at least one screen assembly trackway section that is attachable above a doorway opening and two screen storage columns attachable on either side of a doorway opening; each screen storage column having an L-shaped mounting flange extending therefrom and a housing defining a screen assembly storage chamber that is accessible through an elongated rectangular screen assembly access opening formed longitudinally along a housing side wall, a screen retraction assembly including a screen spool mounted within the screen assembly storage chamber, a screen assembly including a length of plastic screening having rigid aluminum vertical supports spaced along the length thereof and having a first screen end attached to the screen spool; a last vertical support of each screen assembly having magnets provided along the side length thereof and a locking handle with a locking mechanism; the locking handle being sized to prevent passage of the last vertical support through the screen assembly access opening; the at least one screen assembly trackway section including a rigid metal guide support having a mounting flange portion in connection with a guide channel attachment section and a resilient U-shaped trackway guide member forming a screen guide channel sized to receive and hold a top edge of a screen assembly; the resilient U-shaped trackway guide member being attached to the guide channel attachment section such that the screen guide channel opening is oriented at a right angle with respect to the mounting flange; the last vertical supports of the two screen assemblies being positionable adjacent to and in parallel with each other such that the sealing magnets of one last vertical support are in registration with the sealing magnets of the other last vertical support and the locking handle of one last vertical support is lockable to the locking handle of the other last vertical support; each screen storage column being a mirror image of the other screen storage column. The housings of each storage column can be shaped to conform to the architectural style of the building if so desired.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
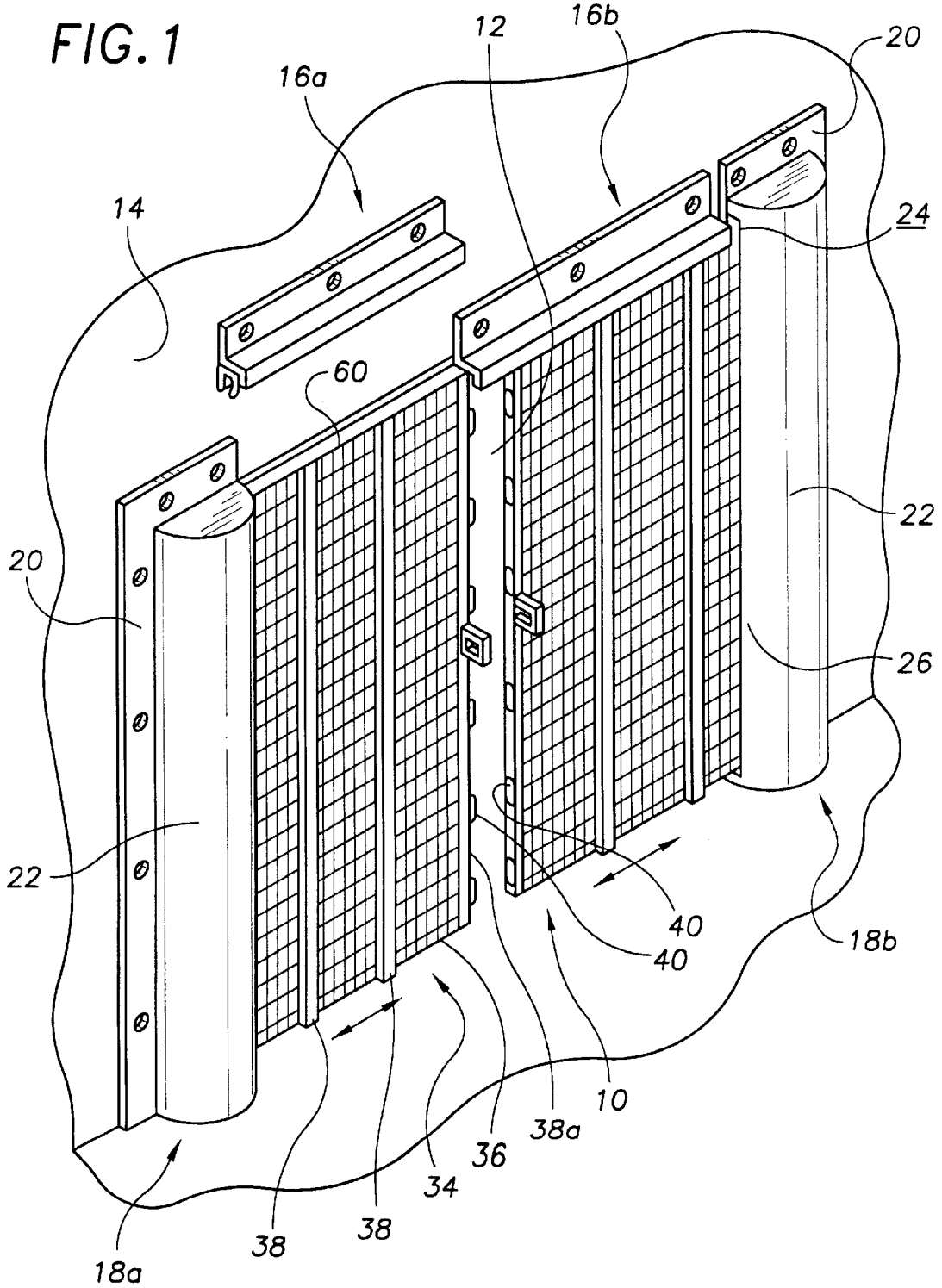
FIG. 1 is a perspective view of an exemplary embodiment of the door opening screening system of the present invention showing the two screen assembly trackway sections and the two screen storage columns each with a section of the stored screen assembly extending out through a rectangular screen assembly access opening and, each rectangular screen assembly being a length of plastic screening having rigid aluminum vertical supports spaced along the length thereof, the last vertical support having magnets provided along the side thereof and a locking handle with a locking mechanism.
Figure 2:
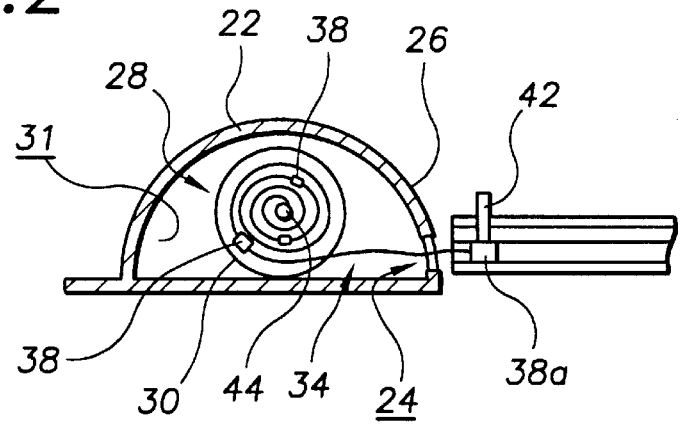
FIG. 2 is a cross sectional view through one of the screen storage columns showing the screen assembly wound onto the screen retraction spool within the screen assembly storage chamber, the screen assembly access opening, the locking handle of the screen assembly positioned outside of the screen assembly storage chamber, and the underside of one of the screen assembly trackway sections showing the guide channel of the resilient, U-shaped trackway guide channel member.

FIG. 1 shows an exemplary embodiment of the door opening screening system of the present invention, generally designated 10, partially installed over a garage door opening 12 in the sidewall 14 of a garage. Door opening screening system 10 includes two identical screen assembly trackway sections, generally designated 16*a*,16*b*, and two mirror image screen storage columns, generally designated 18*a*, 18*b*. Each screen storage column 18*a*,18*b* includes an L-shaped mounting flange 20 that is attached to a half-cylindrical shaped housing 22. L-shaped mounting flange 20 is attachable to sidewall 14 with conventional fasteners such as nails or screws. Each housing 22 has an elongated rectangular screen assembly access opening 24 (see also FIG. 2) formed longitudinally along and through a housing side wall 26. With reference to FIG. 2, a spring rewind, screen retraction assembly 28 including a screen spool 30 is mounted within a screen assembly storage chamber 31 formed within housing 22. Referring back to FIG. 1, a screen assembly, generally designated 34 including a length of plastic screening 36 having a number of rigid aluminum vertical supports 38 spaced along the length thereof. A last vertical support 38*a* of each screen assembly 34 has flexible rubber sealing magnets 40 attached and spaced along the entire side length thereof and, with reference back to FIG. 2, a locking handle 42. Locking handle 42 is sized to prevent passage of last vertical support through screen assembly access opening 24. An end 44 of screen member 36 is secured to screen spool 30. Screen retraction assembly 28 operates in the same manner as a conventional window shade retraction mechanism.

Figure 3:
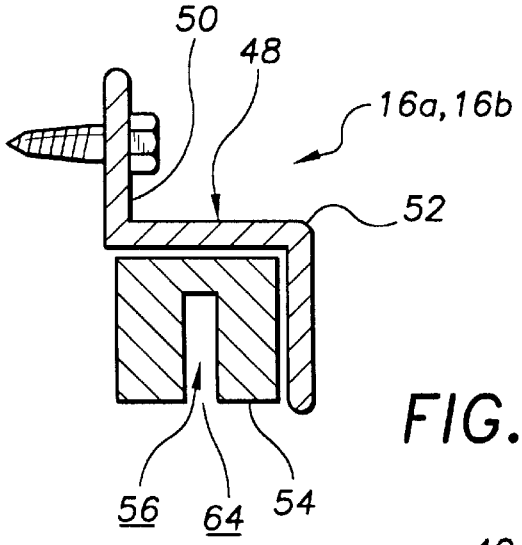
FIG. 3 is an end view of one of the screen assembly trackway sections showing the rigid metal guide support, one of the fastening screws, and the resilient U-shaped trackway guide member forming a screen guide channel.

Referring to FIG. 3, screen assembly trackway sections 16*a*,16*b* are of identical construction and include a rigid metal guide support, generally designated 48, having a planar mounting flange portion 50 integrally formed in connection with a V-shaped cross section guide channel attachment section 52, and a resilient U-shaped trackway guide member 54 having a screen guide channel 56 formed therein that is sized to receive and resiliently slidingly hold a top edge 60 (FIG. 1) of a screen assembly 34 (FIG. 1) so that top edge 60 (FIG. 1) can be slid along screen guide channel 56. Resilient U-shaped trackway guide member 54 is adhesively attached to guide channel attachment section 52 such that a screen guide channel opening 64 is oriented at a right angle with respect to planar mounting flange 50.

Figure 4:
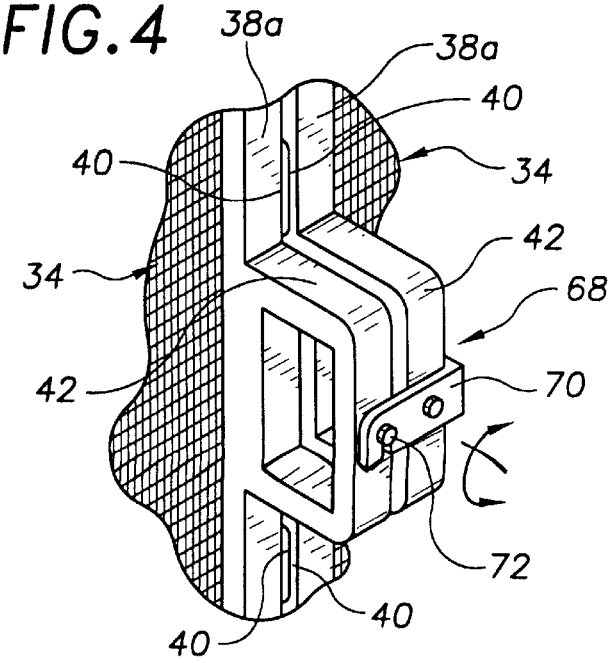
FIG. 4 is a detail perspective view showing the locking handles of the two screen assemblies positioned adjacent to each other and held in place with sealing magnets and a handle locking latch assembly.

With reference to FIG. 4, the last vertical supports 38 of the two screen assemblies 34 are positionable adjacent to and in parallel with each other such that flexible rubber sealing magnets 40 of one last vertical support 38*a* are in registration with the sealing magnets 40 of the other last vertical support 38 and the locking handles 42 lockable together with a locking mechanism, generally designated 68, including a pivoting latch 70 and a latch engaging pin 72.

It can be seen from the preceding description that a door opening screening system has been provided that is suitable for screening large garage door openings; that includes two retractable screen assemblies that are deployed across the garage door opening and that are secured together to form a screen across the garage door opening; and that includes at least one screen assembly trackway section that is attachable above a doorway opening and two screen storage columns attachable on either side of a doorway opening; each screen storage column having an L-shaped mounting flange extending therefrom and a housing defining a screen assembly storage chamber that is accessible through an elongated rectangular screen assembly access opening formed longitudinally along a housing side wall, a screen retraction assembly including a screen spool mounted within the screen assembly storage chamber, a screen assembly including a length of plastic screening having rigid aluminum vertical supports spaced along the length thereof and having a first screen end attached to the screen spool; a last vertical support of each screen assembly having magnets provided along the side length thereof and a locking handle with a locking mechanism; the locking handle being sized to prevent passage of the last vertical support through the screen assembly access opening; the at least one screen assembly trackway section including a rigid metal guide support having a mounting flange portion in connection with a guide channel attachment section and a resilient U-shaped trackway guide member forming a screen guide channel sized to receive and hold a top edge of a screen assembly; the resilient U-shaped trackway guide member being attached to the guide channel attachment section such that the screen guide channel opening is oriented at a right angle with respect to the mounting flange; the last vertical supports of the two screen assemblies being positionable adjacent to and in parallel with each other such that the sealing magnets of one last vertical support are in registration with the sealing magnets of the other last vertical support and the locking handle of one last vertical support is lockable to the locking handle of the other last vertical support; each screen storage column being a mirror image of the other screen storage column.

It is noted that the embodiment of the door opening screening system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A door opening screening system comprising:

at least one screen assembly trackway section; and two screen storage columns, each screen storage column having an L-shaped mounting flange extending therefrom and a housing defining a screen assembly storage chamber that is accessible through an elongated rectangular screen assembly access opening formed longitudinally along a housing side wall, a screen retraction assembly including a screen spool, and a screen assembly including a length of plastic screening having rigid aluminum vertical supports spaced along the length thereof;

said screen retraction assembly being mounted within said screen assembly storage chamber;

said length of plastic screening having a first screen end attached to said screen spool;

each said screen assembly having magnets provided along a side length thereof and a locking handle with a locking mechanism;

said locking handle being sized to prevent passage through said screen assembly access opening into said screen assembly storage chamber;

said at least one screen assembly trackway section including a rigid metal guide support having a planar mounting flange portion in connection with a guide channel attachment section and a resilient U-shaped trackway guide member forming a screen guide channel sized to receive and hold a top edge of a screen assembly;

said resilient U-shaped trackway guide member being attached to said guide channel attachment section such that said screen guide channel opening is oriented at a right angle with respect to said planar mounting flange;

said magnets of said two screen assemblies being positionable adjacent to and in parallel with each other such that said magnets of one said screen assembly are in registration with said magnets of the other said screen assembly and said locking handle of one said screen assembly is lockable to said locking handle of the other said screen assembly.

* * * * *